US006880234B2

(12) United States Patent
Khan

(10) Patent No.: US 6,880,234 B2
(45) Date of Patent: Apr. 19, 2005

(54) METHOD FOR THIN FILM NTC THERMISTOR

(75) Inventor: Javed Khan, Norfolk, NE (US)

(73) Assignee: Vishay Intertechnology, Inc., Malvern, PA (US)

( * ) Notice: Subject to any disclaimer, the term of this patent is extended or adjusted under 35 U.S.C. 154(b) by 11 days.

(21) Appl. No.: 09/810,206

(22) Filed: Mar. 16, 2001

(65) Prior Publication Data

US 2002/0130758 A1 Sep. 19, 2002

(51) Int. Cl.[7] ..... H01C 17/06

(52) U.S. Cl. ..... 29/620; 29/610.1; 29/612; 338/7; 338/9

(58) Field of Search ..... 338/7, 8, 9; 29/610.1, 29/611, 612, 620, 610, 613–619, 621.1

(56) References Cited

U.S. PATENT DOCUMENTS

| | | | | |
|---|---|---|---|---|
| 3,109,227 A | * | 11/1963 | Goodyear | 29/619 |
| 3,510,820 A | | 5/1970 | Jonker et al. | |
| 3,574,930 A | * | 4/1971 | Riddel et al. | 29/612 |
| 3,629,585 A | | 12/1971 | Desvignes et al. | |
| 4,423,403 A | * | 12/1983 | Miyake et al. | 338/15 |
| 4,498,071 A | * | 2/1985 | Plough et al. | 204/192.21 |
| 4,805,296 A | * | 2/1989 | Jinda et al. | 29/620 |
| 5,024,966 A | * | 6/1991 | Dietrich et al. | 437/60 |
| 5,206,624 A | * | 4/1993 | Patel et al. | 338/308 |
| 5,273,776 A | | 12/1993 | Yonezawa et al. | |
| 5,994,756 A | * | 11/1999 | Umezawa et al. | 257/510 |
| 6,004,471 A | * | 12/1999 | Chaung | 216/16 |
| 6,099,164 A | * | 8/2000 | Rosen et al. | 117/946 |
| 6,309,695 B1 | * | 10/2001 | Singh | 427/103 |
| 6,314,637 B1 | * | 11/2001 | Kimura et al. | 29/610.1 |

FOREIGN PATENT DOCUMENTS

| | | |
|---|---|---|
| EP | 0 609 776 A1 | 8/1994 |
| GB | 2150748 A | 7/1985 |
| JP | 07109560 | 11/1996 |

OTHER PUBLICATIONS

Bunshah et al (Deposition Technologies for Films and Coatings).*

* cited by examiner

*Primary Examiner*—Rick Kiltae Chang
(74) *Attorney, Agent, or Firm*—McKee, Voorhees & Sease, P.L.C.

(57) ABSTRACT

A method for manufacturing a thin film negative temperature coefficient thermistor is disclosed. The method includes selecting a negative temperature coefficient of resistance versus temperature curve, selecting a mixture of metal film materials to provide the negative temperature coefficient of resistance curve while maintaining a desired physical size, and depositing the mixture of metal film materials on a substrate.

8 Claims, 3 Drawing Sheets

METHOD FOR THIN FILM NTC THERMISTOR

BACKGROUND OF THE INVENTION

A. Field of the Invention

This invention relates to a method and apparatus for a thin film negative temperature coefficient (NTC) thermistor.

B. Problems in the Art

The current process of making a negative temperature coefficient of resistance thermistor has a number of deficiencies. In the current process, a mixture of metal oxide powders is weighed and mixed with organic materials being added as binders. Once mixed, the mixture is ground and tape casted to turn the metal oxide powder into a thin and flexible tape-like material. These thin tapes of metal oxide materials are then cut into pieces, stacked one on top of each other and pressed. The resulting product at this point of the process is called a raw wafer. The raw wafer is then fired at approximately 1100° C. for nearly seven days. This includes the ramp up and ramp down time to and from that temperature. The aforementioned process is considered to be the preprocessing of the thermistor. After preprocessing, a thick film glass dielectric is sprayed on the top and the bottom of the preprocessed wafer. Then parts are diced to the desired width and broken into strips. Glass dielectric is then sprayed on the edges. The resulting pieces are then cut to a length to obtain the correct and desired resistance values. Termination is then performed on the open edges, that is the edges without glass dielectric, by dipping the edges into platable silver ink. The thermistor is later fired at approximately 650° C. and electroplated with Nickel and tin-lead, or other solder material.

This current process produces a number of problems and deficiencies. One problem is that the process takes too long due to the long time period of firing.

Another problem is that the resistance value is dependent in part upon the physical size of the resulting thermistor.

Another problem is that because of the thickness of the device, the thermistor takes a longer amount of time to heat up than is desirable.

Another problem is the resistance tolerance associated with the thermistor. Because the material composition in a particular thermistor can vary, the resistance varies as well, resulting in a tolerance that is greater than desired.

Thus it is a primary objective of the present invention to provide a negative temperature coefficient of resistance thermistor which improves upon the state of the art.

Yet another objective of the present invention is to provide a thermistor which is predictable.

Another objective of the present invention is to reduce material costs in manufacturing.

Another objective of the present invention is to reduce labor costs associated with manufacturing.

Another objective of the present invention is to make a thermistor with a tighter resistance tolerance.

Another objective of the present invention is to provide a thermistor with reduced manufacturing time required.

Another objective of the present invention is to provide a negative temperature coefficient of resistance thermistor that can be manufactured with thin film techniques.

Another objective of the present invention is to provide a thin film thermistor having the advantage of reduced heating time.

It is another objective of the present invention to provide a negative temperature coefficient thermistor having the advantage of reduced thickness.

It is another objective of the present invention to provide a negative temperature coefficient resistor having increased sensitivity to temperature changes.

These and other objectives, features, or advantages of the present invention will become apparent from the specification and claims.

SUMMARY OF THE INVENTION

The present invention is a method and apparatus for a negative temperature coefficient thermistor. The invention provides for a thin film negative temperature coefficient of resistance thermistor. The NTC thermistor of the present invention results in the ability to have standardized sizes of resistors in that the resistance value need not be dependent upon the physical size of the thermistor. The present invention also provides for the advantages of having tighter resistance tolerance and increased sensitivity to temperature change. In addition the present invention provides for reduced material costs, reduced labor costs, and reduced manufacturing time.

DESCRIPTION OF THE PREFERRED EMBODIMENT

Figure 1:
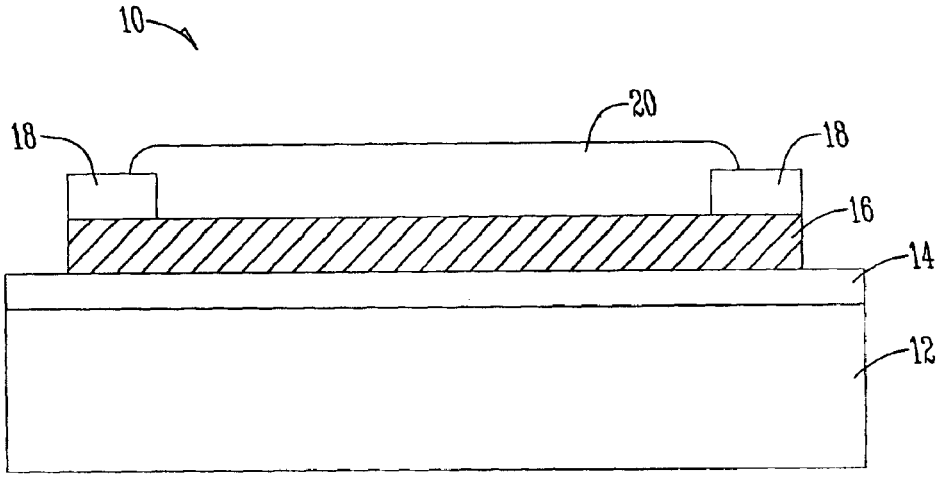
FIG. 1 is a side view of the NTC thermistor after preprocessing.

With reference to the drawings, the same reference numerals or letters will indicate the same parts or locations throughout the drawings unless otherwise indicated.

FIG. 1 shows the NTC thermistor of the present invention after preprocessing. As shown in FIG. 1, the NTC thermistor 10 has a substrate 12. The substrate 12 may be alumina or other substrate that is used in thin film processes. The substrate 12 has a layer of silicon nitride 14 such as may be used in a planarization process. The present invention contemplates that other substrates and other planarization materials may be used such as are known in the art. The present invention also contemplates that no planarization is performed. If planarization is not performed, the performance of the resulting NTC thermistor will not be reduced. The preprocessed NTC thermistor also includes a metal oxide film 16. The metal oxide film 16 is a mixture of metal oxides such as manganese oxide or nickel oxide. The metal oxide film materials selected in the mixture of metal oxide film materials used is selected in part by the desired temperature response. For example, one mixture of metal oxide films that may be used contains a mixture of 82% $Mn_2O_3$ to 18% NiO. The present invention contemplates that other metal oxide films may be used and other mixtures of oxide films may be used as a particular application may suggest. This metal oxide mixture film is deposited using sputtering or other physical vapor deposition (PVD) processes.

The preprocessed NTC thermistor of the present invention also includes conductor termination 18. Conductor termination 18 may consist of platinum, gold, or an alloy, or other conductive metal, that is applied through a sputtering process.

The preprocessed NTC thermistor of the present invention also includes a passivation layer 20. The passivation layer 20 is a deposited scratch resistant material such as silicon nitride, silicon dioxide, or other material such as may be known in the art. The passivation layer is used to protect the NTC thermistor's electronic properties from deterioration from external contaminants. The present invention also contemplates that the passivation layer need not be used. It is to be appreciated that a thin film NTC thermistor without the passivation layer will not have lower performance.

Figure 2:
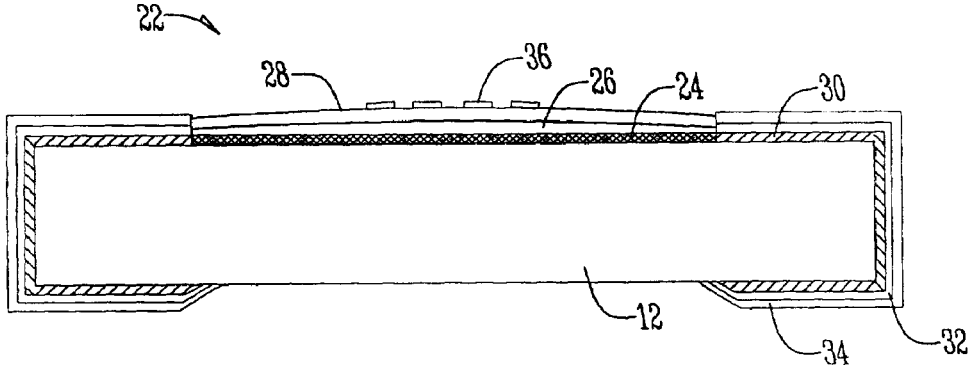
FIG. 2 is a side view of the NTC thermistor of the present invention.

FIG. 2 shows the thin film NTC thermistor of the present invention. The thin film thermistor 22 is shown as completed. The thin film thermistor 22 has a resistive element 24 which is of the metal oxide mixture. In addition, the thin film NTC thermistor has a moisture barrier 26 to protect the resistive element from deterioration of electronic properties caused by water, ions, and other external contaminants. The thin film NTC thermistor also has a polymer dielectric 28. The thin film NTC thermistor of the present invention also includes an additional terminal 30 formed through a sputtering process. The present invention contemplates that the nichrome and copper need only be applied to the end and bottom portions of the termination. The termination 30 is created through a sputtering process applying nichrome and then copper for the termination. The present invention contemplates that other conductive materials can be sputtered. The sputtered termination of the present invention is plated with a nickel barrier 32. Nickel is known to have a high specific heat capacity. Thus, nickel is used to reduce resistive heating. The nickel barrier 32 is also plated with a solder material 34 such as is well known in the art.

Figure 3:
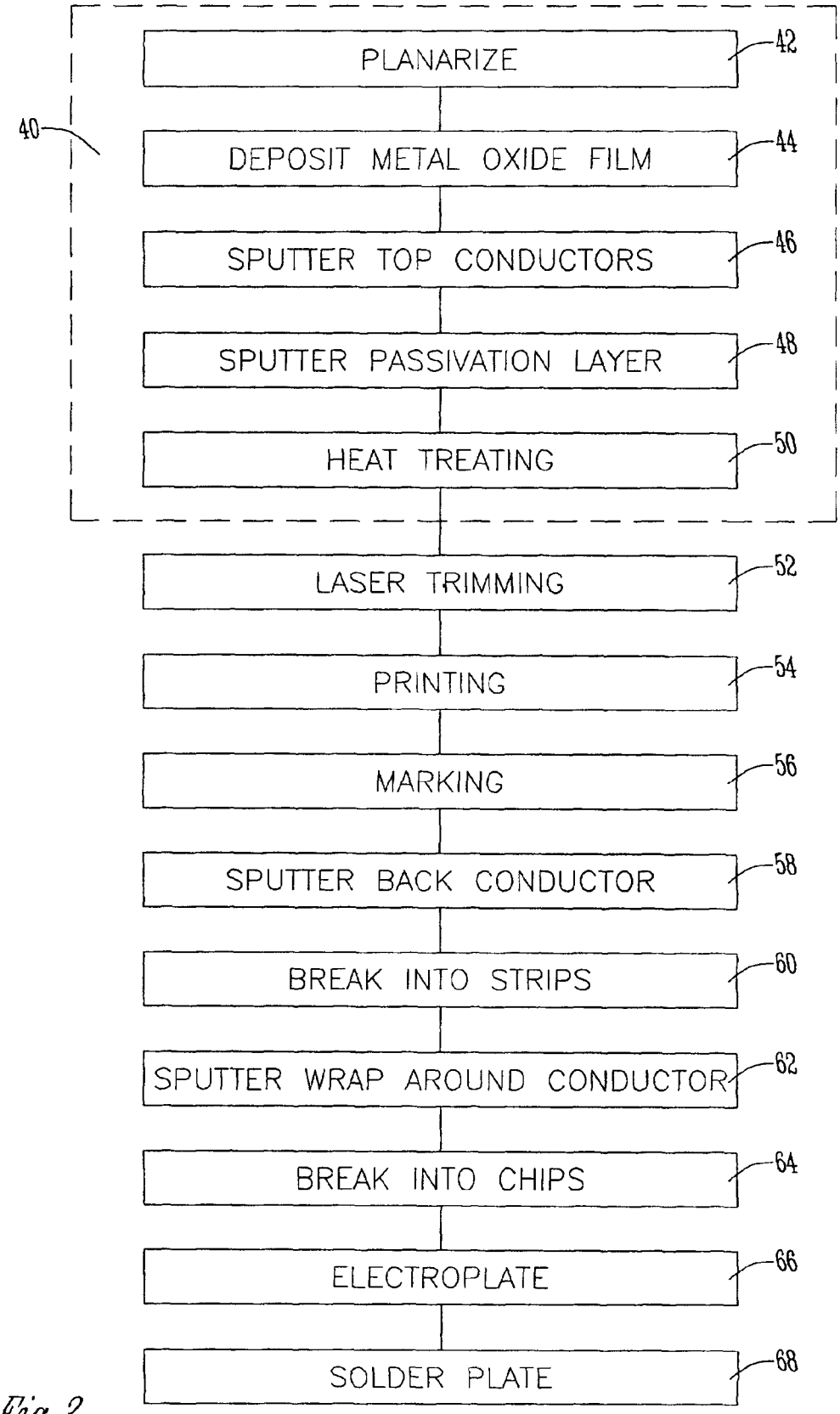
FIG. 3 is a flow chart showing the manufacturing steps involved in manufacturing the NTC thermistor of the present invention.

The manufacturing process of the present invention is detailed in FIG. 3. The process includes the preprocessing steps 40. In preprocessing steps 40, first planarization of the substrate occurs. The planarization process smoothes the contours of the wafer surface. This can be done by applying silicon nitride to the clean surface of the substrate. After the planarized step 42, metal oxide film is deposited in step 44. The metal oxide film is deposited after photoprocessing (or solder masking) such as is known in the art. The metal oxide film, as previously discussed, may be a manganese oxide and nickel oxide mixture at a ratio of 82% to 18%. The precise ratio selected affects the resistance of the thin film NTC thermistor at various temperatures. Thus, different mixtures of metal oxides may be used to achieve different properties in the resulting NTC thermistor. Modification of the mixture using other metal oxide films at other ratios may be performed. The particular mixture selected based on the desired properties of the thermistor such as the size of the thermistor and the associated curve of the thermistor as is later discussed.

Next, the terminals for the top conductor are created in step 46 according to a photo process and sputtering step, such as is known in the art. Referring back to FIG. 1, the sputtering process results in the terminals 18. Referring back to FIG. 3, the next step is the sputtering of the passivation layer in step 48. The passivation layer being a deposition of a scratch resistant material such as silicon nitride or silicon dioxide to prevent deterioration as previously discussed. After the addition of the passivation layer in step 48, the resulting product is heat treated in step 50. Heat treating is used to stabilize the device as is known in the art.

After preprocessing, additional steps are applied to the thermistor. These additional steps are thin film processing steps such as are known in the art as applied to other types of devices. In step 52, laser trimming is used to trim the film. In step 54, the Tokyo Paint is printed and the Minico Dielectric or other dielectric is also printed. The present invention contemplates that other inks or materials may be used such as are well known in the art. In step 56 marking occurs to prepare for separation. In step 58 the back conductor is sputtered on to the back of the device. In step 60, the wafer is broken into strips. In step 62 sputtering around the conductor is performed. In step 64 the wafer is broken into chips. In step 66 the thin film NTC thermistor chip is electroplated with nickel. In step 68 the thin film NTC thermistor is solder plated.

It will be readily apparent to those skilled in the art that different types and mixtures of metal oxide films may be used. It will also be clear to those skilled in the art that different types of substrate materials, passivation layer materials, terminal conductor materials, electroplated barrier materials and solder plating materials may be used, and other variations such as may be required by particular applications and environments, or to develop thermistors with particular properties.

As previously explained, different compositions of metal film materials can be used to achieve different resistances. Thus the present invention allows for thermistors having different resistances at a given temperature to be the same physical size. This relationship between resistance and temperature generally being quantified with a curve, such as is known in the art. This advantage of the present inventions permits NTC thermistors having different curves to be manufactured in the same size. Thus a particular size of thermistor may be made from different mixtures of film materials thus yielding different negative temperature coefficient versus temperature curves.

Figure 4:
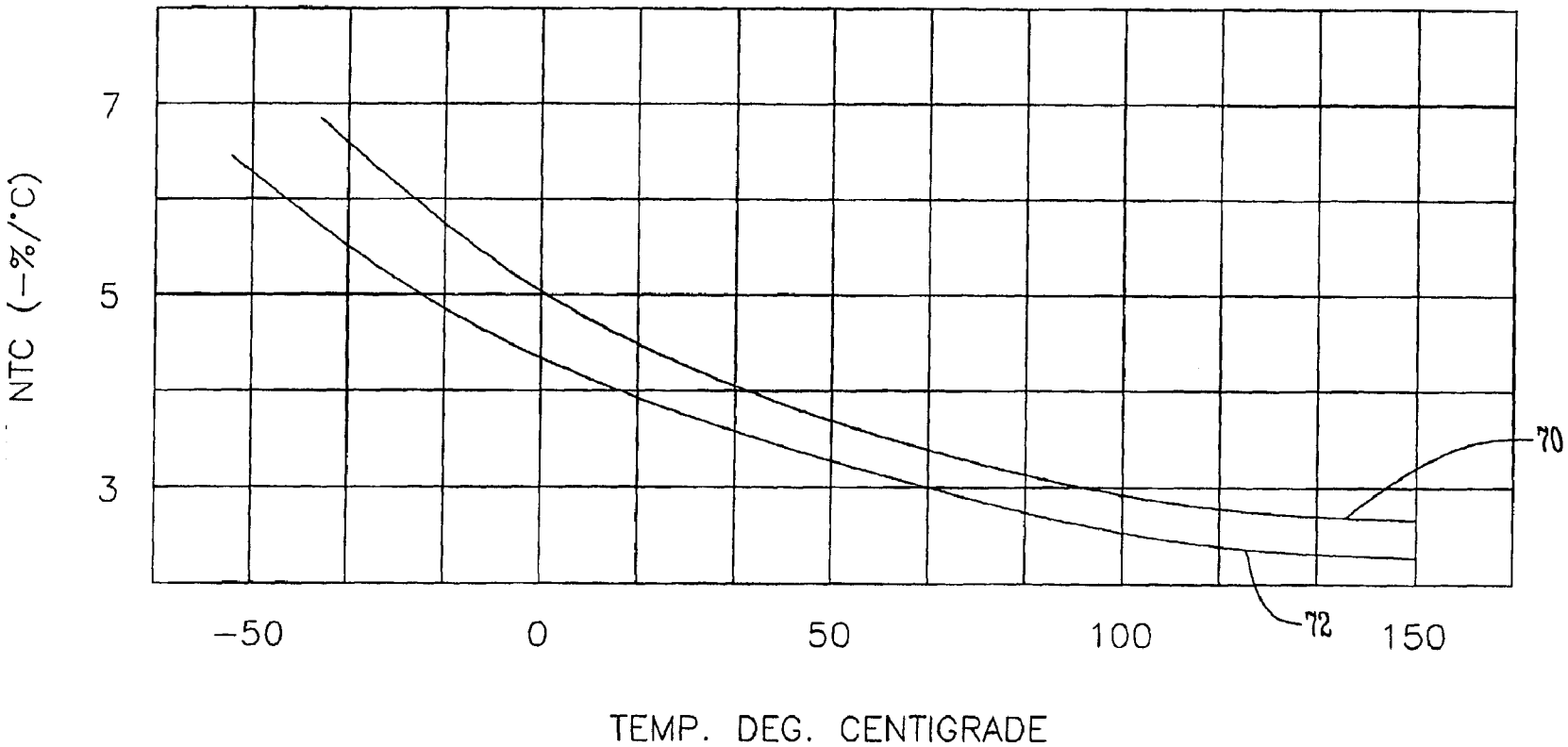
FIG. 4 is a diagram of a negative temperature coefficient of resistance versus temperature curve of the present invention.

FIG. 4 shows two representative negative temperature coefficient of resistance versus temperature curves. The negative temperature coefficient is expressed in percent resistance change per degree celsius. The present invention allows two different NTC thermistors having the same physical size to have different curves, such as curve 70 and curve 72. This advantage allows package sizes to be standardized. This standardization may further reduce manufacturing costs. This standardization also simplifies the process of incorporating an NTC thermistor into an electronics design.

Thus an apparatus and method for a thin film NTC thermistor has been disclosed which solves problems and deficiencies in the art.

What is claimed is:

1. A method of manufacturing a thin film negative temperature coefficient thermistor comprising:

selecting a mixture of metal oxides to provide a negative temperature coefficient of resistance versus temperature curve while maintaining a standardized physical size for the thermistor; and sputter depositing the mixture of metal oxides on an alumina substrate using a thin film process to form a resistive element.

2. The method of claim 1 wherein the mixture is a mixture of manganese oxide and nickel oxide.

3. The method of manufacturing a thin film negative temperature coefficient thermistor of claim 1 further comprising:

planarizing a substrate prior to the depositing step;

sputtering conductor terminals;

sputtering a passivation layer; and heat treating.

4. The method of claim 3 wherein the step of planarizing is applying silicon nitride film.

5. The method of claim 3 wherein the step of sputtering a passivation layer is sputtering silicon nitride film.

6. The method of claim 1 wherein the step of depositing is sputter depositing.

7. A method of manufacturing a thin film negative temperature coefficient thermistor, comprising:

selecting a mixture of metal oxides to provide desired negative temperature coefficient of resistance properties and sputter depositing the metal film oxides on an alumina substrate to form a thin film resistive element.

8. A method of manufacturing a thin film negative temperature coefficient thermistor of a standardized package size, comprising sputter depositing a mixture of metal oxides on an alumina substrate to form a thin film resistive element, the mixture of metal oxides selected to provide for desired negative temperature coefficient of resistance properties while maintaining the standardized package size.

* * * * *